US010952483B2

(12) United States Patent
Thomas

(10) Patent No.: US 10,952,483 B2
(45) Date of Patent: Mar. 23, 2021

(54) HEAD COVERING AND PROTECTOR WITH COIFFURED APPEARENCE

(71) Applicant: Tennille Thomas, Collierville, TN (US)

(72) Inventor: Tennille Thomas, Collierville, TN (US)

( * ) Notice: Subject to any disclaimer, the term of this patent is extended or adjusted under 35 U.S.C. 154(b) by 89 days.

(21) Appl. No.: 15/668,976

(22) Filed: Aug. 4, 2017

(65) Prior Publication Data

US 2018/0077988 A1 Mar. 22, 2018

Related U.S. Application Data

(60) Provisional application No. 62/395,408, filed on Sep. 16, 2016.

(51) Int. Cl.

| | |
|---|---|
| ***A42B 1/04*** | (2006.01) |
| ***A45D 8/40*** | (2006.01) |
| ***A42B 1/16*** | (2006.01) |
| ***A42B 7/00*** | (2006.01) |
| ***A42B 1/041*** | (2021.01) |

(52) U.S. Cl.

CPC ..... *A42B 1/041* (2013.01); *A42B 1/04* (2013.01); *A42B 1/16* (2013.01); *A42B 7/00* (2013.01); *A45D 8/40* (2013.01)

(58) Field of Classification Search

CPC .. A42B 1/04; A42B 1/12; A42B 1/041; A42B 1/043; A42B 1/16; A42B 1/205; A42B 1/045; A42B 1/225; A45D 8/40

USPC ..... D2/869, 868

See application file for complete search history.

(56) References Cited

U.S. PATENT DOCUMENTS

| | | | | | |
|---|---|---|---|---|---|
| 1,518,049 | A * | 12/1924 | Chocksee | A42B 1/041 | 2/200.1 |
| RE34,186 | E * | 3/1993 | Moen | A41G 5/0093 | 132/274 |
| 2008/0010721 | A1* | 1/2008 | Campbell | A42B 1/069 | 2/181.4 |
| 2009/0055995 | A1* | 3/2009 | Garza | A42B 1/006 | 2/209.11 |
| 2010/0192282 | A1* | 8/2010 | Matthews | A45D 8/40 | 2/174 |
| 2016/0198830 | A1* | 7/2016 | Tussey | A42B 1/041 | 2/183 |
| 2018/0064196 | A1* | 3/2018 | Thompson-Buist | A42B 1/041 | |

FOREIGN PATENT DOCUMENTS

| | | | | |
|---|---|---|---|---|
| CN | 202588441 U | * | 12/2012 | |
| GB | 232492 A | * | 4/1925 | A42B 1/24 |
| JP | 2008163524 A | * | 7/2008 | |

OTHER PUBLICATIONS

Mo KNows Hair; Youtube.com video; Flor Bella Boutique Satin Accessories Review; accessed on Mar. 27, 2019; published on Oct. 21, 2013. (Year: 2013).*

Artofwhere.com; beanies product website; https://artofwhere.com/products/beanies; accessed Mar. 29, 2019; captured online on Jun. 10, 2016. (Year: 2016).*

* cited by examiner

*Primary Examiner* — Daniel J Colilla

(74) *Attorney, Agent, or Firm* — Butler Snow LLP

(57) ABSTRACT

Head ware and related methods for protecting a wearer's head and hair, that also presents the appearance of a coiffure, is provided.

15 Claims, 6 Drawing Sheets

HEAD COVERING AND PROTECTOR WITH COIFFURED APPEARENCE

1 NOTICE OF COPYRIGHT

Portions of this patent application include materials that are subject to copyright protection. The copyright owner has no objection to the facsimile reproduction by anyone of the patent document itself, or of the patent application, as it appears in the files of the United States Patent and Trademark Office, but otherwise reserves all copyright rights whatsoever in such included copyrighted materials.

2 BACKGROUND OF THE INVENTION

2.1 Field of the Invention

The present invention provides head ware and related methods for protecting a wearer's head and hair that also presents the appearance of a coiffure. The present invention has applications in the fields of millinery and protective outerwear, and more particularly fashion, beauty and hair-care industries.

2.2 The Related Art

Hair plays an important role in one's self-image. Throughout history, beautiful healthy hair has been associated with wealth and status, as well as overall beauty. In fact, royalty and those of high class, from the Egyptians to British Parliament, have historically worn elaborate wigs and other adornment of the hair to reflect their status and wealth. The role of hair in our sense of attractiveness and self-esteem has not diminished over the centuries. So it is no wonder that hair care and the desire to maintain healthy beautiful hair, represents an $11.6 B industry in the United States.

In addition to hair styling services for both men and women, products and accessories to care for, maintain and improve the appearance of the hair make up a large part of the industry's revenue. Industry trends towards healthy natural hair and protective wigs and weaving has resulted in innovative products to help those wanting to protect various styles and prevent damage or loss of hair, as well as cover or disguise current damage or hair loss.

A wide variety U.S. patents and published patent applications, both utility and design, describe attempts to address these issues. Representative examples include: U.S. Pat. Nos. 7,895,672; 8,266,721; 6,622,310; D641,140; D628,775; D515,285; D627,954; and D617,980.

U.S. Pat. No. 7,895,672 describes (Abstract), "[a] head covering bonnet with an opening for the head and an elastic spandex band below the opening for holding the bonnet to the head. The spandex band is of a width so as not to apply high localized pressure on the hair, and spandex is not rough or abrasive when stretched, unlike typical elastic material which becomes rough and possibly abrasive to hair when the elastic is stretched."

U.S. Pat. No. 8,266,721 describes (Abstract), "[a]n artful head covering made of cloth and other materials, existing in three embodiments, each sequentially dependent on the one before it. All embodiments including a cap portion comprised of a curved upper crown with a straight lower edge connected to a band portion comprised of a straight upper edge and a curved lower edge. The second embodiment has fasteners attached to the exterior of the cap portion of the head covering for added dimension along with serving a function in the third embodiment in which strands comprised of additional fasteners and artful objects are connected to some or all of the fasteners of embodiment 2. The head covering is secure and covers the portion of the head that is normally covered with hair. A fun and creative head covering for hair loss, or solely for fashionable purposes, that is comfortable and flattering to the face."

U.S. Pat. No. 6,622,310 describes (Abstract), "[a] hair cover [that] is composed of a top and a bottom piece, in which the top piece further comprises a relatively longer side, an opposite relatively shorter side, and two arcuate equilateral sides; the bottom piece is correspondingly shaped to the top piece, having also a relatively longer side, a shorter side, two arcuate equilateral sides, and a central through hole. The top and the bottom piece are to be combined together by binding thermally the corresponding portions of each piece to form a trapezoid hair cover that is capable of promoting the wearing comfortableness considerably. In wearing the hair cover, one's head is put penetrating the central hole to have his hair shaded closely from his forehead and his longer hair portion shaded in a wider rear end by taking advantage of the natural stretchability of the resilient cloth of the hair cover."

U.S. Pat. No. D641,140 describes (Abstract), describes ornamentally a hair covering including a opening dimentioned to fit closely around a wearer's forehead having an elevated extension upwards from the forehead with a rearward extended volume dimensioned to accept the user's hair.

U.S. Pat. No. D515,284 describes (Abstract), describes ornamentally coneshaped container dimensioned to accept the wearer's hair with a snugly-fitting opening dimensioned to fit around the wearer's forehead.

U.S. Pat. No. D6,278,954 describes (Abstract), describes ornamentally a hemi-spherical head covering dimensioned to accept a wearer's hair, with a cinch-type fastener around the circumference of the opening dimensioned to fit the covering closely to the wearer's head.

U.S. Pat. No. D62,875 describes (Abstract), describes ornamentally a beret-shaped head covering dimensioned to accept a wearer's hair, with an opening dimensioned to cover closely the wearer's head.

U.S. Design Pat. No. D627,954 describes a protective hair cap having a hair covering attached to an adjustable band. The covering also includes a flap at the back of the cap.

U.S. Design Pat. No. D641,140 describes a protective hair cap having a snood-shaped hair covering gathered at an elastic band. The snood-shape of the covering is not suitable for protecting many hair styles that are shaped upward from the head, rather than extending down the back of the head.

However, these hair coverings are purely functional, without any meaningful aesthetic value. Each looks like a head covering. But in many situations, wearers would like to have both functional hair (and head) protection as well as an attractive appearance. The latter is especially important if the wearer must appear in public. In particular, some wearers would like to have hair protection that provides the appearance of coiffured hair, thus projecting a vision of normalcy.

Thus, there remains an unsatisfied need to provide hair coverings that are effective to protect hair styles during activities such as while providing a pleasing aesthetic appearance. The present invention meets these and other needs.

3 SUMMARY OF EMBODIMENTS OF THE INVENTION

The present invention provides novel and useful head coverings that protect the wearer's hair (and head) with a stylish appearance.

In a one aspect, the present invention provides a head covering configured to protect a wearer's hair and provide a simulated hair style. In some embodiments, the head covering comprises: an inner bonnet that includes at least one layer of fabric material and is dimensioned to fit a wearer's head and substantially protect said wearer's hair. An outer bonnet is also provided that includes at least one layer of fabric material and is dimensioned to fit over to inner bonnet to cover substantially the inner bonnet from external view. The outer bonnet is configured to appear substantially as a coiffure. The inner bonnet and and outer bonnet are coupled together to form the head covering.

In more specific embodiments, the inner bonnet comprises one or two layers. In still more specific embodiments, the layers of the inner bonnet comprise a plurality of panels. In more particular embodiments, the panels of the inner bonnet comprise fewer than about seven panels; and in yet more particular embodiments, the panels are doubled.

In other more specific embodiments, the outer bonnet has a substantially defined surface contour, and the inner bonnet is dimensioned to support the surface contour.

In still other more specific embodiments, the outer bonnet comprises one or two layers. More specifically, the outer bonnet comprises a plurality of panels, and still more specifically, the outer bonnet comprises fewer than about seven panels. In yet more specific embodiments, the panels are doubled.

In some embodiments, the above-described head covering comprises an accessory.

In other embodiments, the outer bonnet comprises an outer surface on to which a coiffure is printed.

In still other embodiments, the inner bonnet comprises a wrap configuration. In more specific embodiments, the wrap configuration of the inner bonnet comprises one panel or two panels, is double-lined, and is dimensioned to substantially traverse the circumference of the wearer's head such that the crown of the wearer's head is substantially exposed. In still more specific embodiments in which the inner bonnet is a wrap configuration exposing the wearer's crown, the outer bonnet comprises at least about four panels, is double-lined, and dimensioned to accommodate the volume of hair at the crown of the wearer's head. Yet more specific embodiments of this combination further comprise an attachment that comprises a double-lined substantially elastic fabric, and coupled with the outer surface of the outer bonnet.

The head covering of claim 1, wherein the each of inner bonnet and the outer bonnet comprises silk or satin. In more specific embodiments, the inner bonnet is satin, and the outer bonnet is silk. In still more specific embodiments, the inner bonnet is Charmeuse satin. In other more specific embodiments, the outer bonnet is China silk. In some embodiments, the outer bonnet is both satin (facing out) and silk (facing in).

Still other embodiments and advantages will become apparent when the present Specification is read with the accompanying Drawings.

4 BRIEF DESCRIPTION OF THE DRAWINGS

Exemplary embodiments of the present invention are described herein with reference to the following drawings, in which.

5 DETAILED DESCRIPTION OF SOME EMBODIMENTS OF THE INVENTION

5.1 Definitions

Figure 1B:
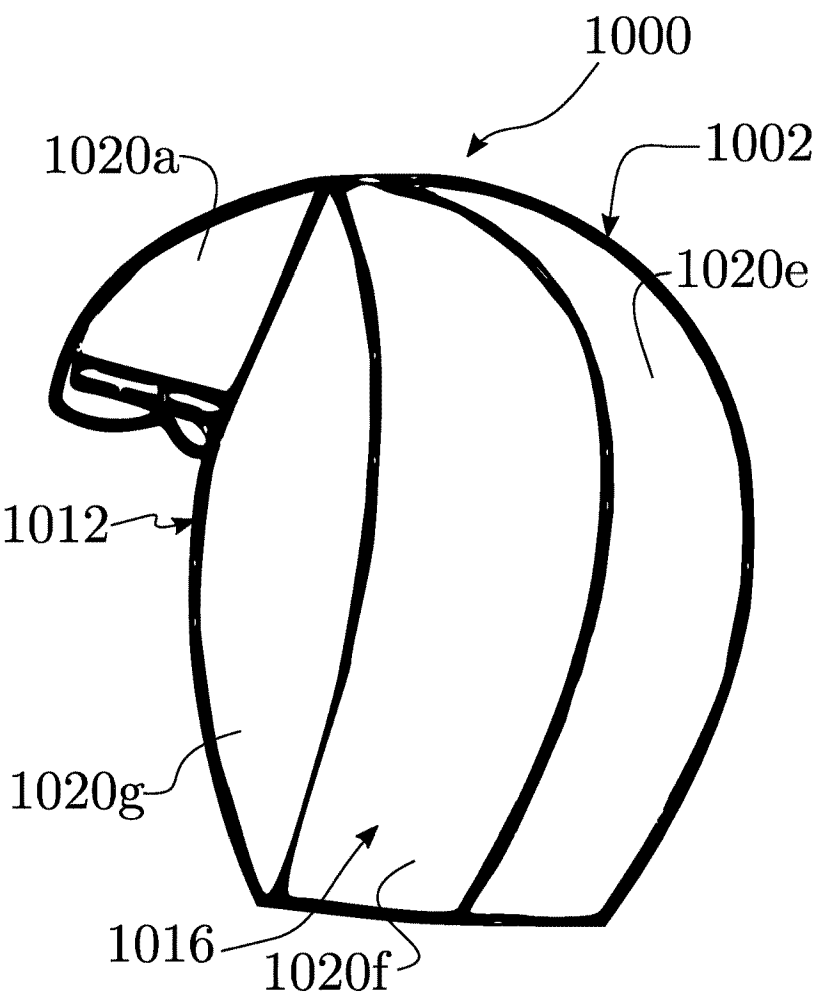
FIGS. 1A and 1B are front (FIG. 1A) and side (FIG. 1B) views of a hair covering in accordance with one embodiment of the present invention.

Unless indicated otherwise, the following terms and definitions will apply herein.

Layer A single layer of fabric as produced. Generally a layer has both a finished side and an unfinished side.

Panel A section of the pattern that is designated to be cut into an individual shape for sewing together with the other panels of the pattern to make the article.

Double-Lined Two single layers of fabric aligned together with dull/unfinished sides facing one another, cut and sewn into a panel that is finished on both sides. A double-lined panel has two of the same panel pieces, made from two fabric layers and combined into an individual panel piece of the pattern.

Double-Faced This is a single layer of fabric that comes produced with two finished sides, allowing for the potential of a single layer of panel that is finished on both sides and does not required the double-lined method to create a finished side.

Doubled Panels made using the double-lined method.

The present invention provides a head covering that can provide at least a degree of protection of the wearer's hair from damage, the elements, and dishevelment. In some embodiments, the head covering is a bonnet system comprising at least an inner and outer bonnet. Among those embodiments, the inner bonnet provides protection of the hair; and the outer bonnet provides an aesthetic appearance of a hairstyle, and is interchangeable to allow the use of various styles in the bonnet system. In some embodiments, the wearer is able to choose outer bonnets that provide an appearance of a desired hairstyle and inner bonnets that are appropriate for their volume and length of hair. The bonnet system can also be used to protect various types of head gear, helmets, sportswear, machine, appliance, and objects. In a preferred embodiment, the bonnet system has interchangeable parts for versatility; it also incorporates reversible, multi-positional, and detachable elements.

Uses for the head covering of the present invention include, but are not limited to: sleeping, athletic workout, exercise activity, leisure, hospital stay, and the covering of hair loss, baldness, or hair loss prevention. Still other uses include, but are not limited to: protective covering for alopecia, balding prevention, or concealment of baldness; wig alternatives; fashion application; costumes; and entertainment; a garment forming part of a person's uniform (e.g., head covering for foodservice and care providers); UV tanning protection; promotional marketing, advertising, social, organizational, cultural, and religious purposes, and decorative covering for appliance, machine or object.

The invention is constructed from various types of cloth fabric that are assembled and sewn together to create the head covering provided by the present invention. In some embodiments, the present invention includes a minimum of inner and outer bonnet parts, each part having one or two fabric panels to have finished sides both in and out. Some fabrics are finished on both sides. The inner bonnet is usually, although not always, one layer. In general, the inner bonnet front panel is only one layer if double-faced, and two if the double-lined method is required to create the two finished sides.

The inner bonnet is the base of the bonnet system that protects the hair; it also supports the shape and form of the outer bonnet. The layers of the outer and inner bonnet can include panels: vertical or horizontal sections of fabric material. The inner and outer bonnets can each include a range of panels from one single panel, up to about seven panels each. The number of these panels can be doubled (i.e., to about 14 panels each), based on the whether single or double lined layers are used.

The outer bonnet provides an aesthetic impact through its printed design imagery, shape and form. The outer bonnet is also a protective layer for the inner bonnet.

The inner and outer bonnets are made from panels that are cut and sewn together to create the outer and inner bonnets. Front panels are often, but not necessarily, double-sided layers of fabric material, and each set of layers has multiple panels of fabric, which are sewn together to accomplish a complete bonnet system as described herein. The layers can be formed from a single (double-faced) layer of fabric used for both the inner and outer bonnet; or from two layers of fabric that are cut and stitched, surged, or merged together to create a double-lined layer. The single or double-lined layers are used to create a uniform panel of fabric.

Figure 1A:
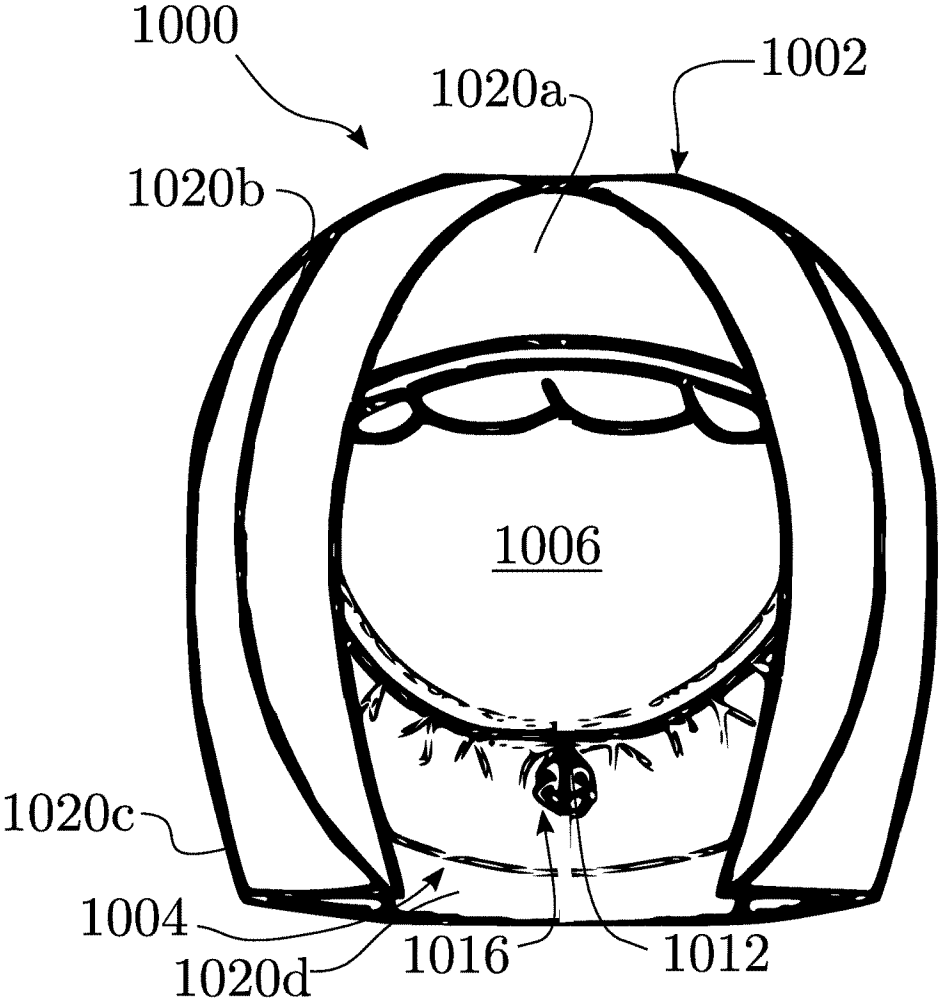
Figure 3A:
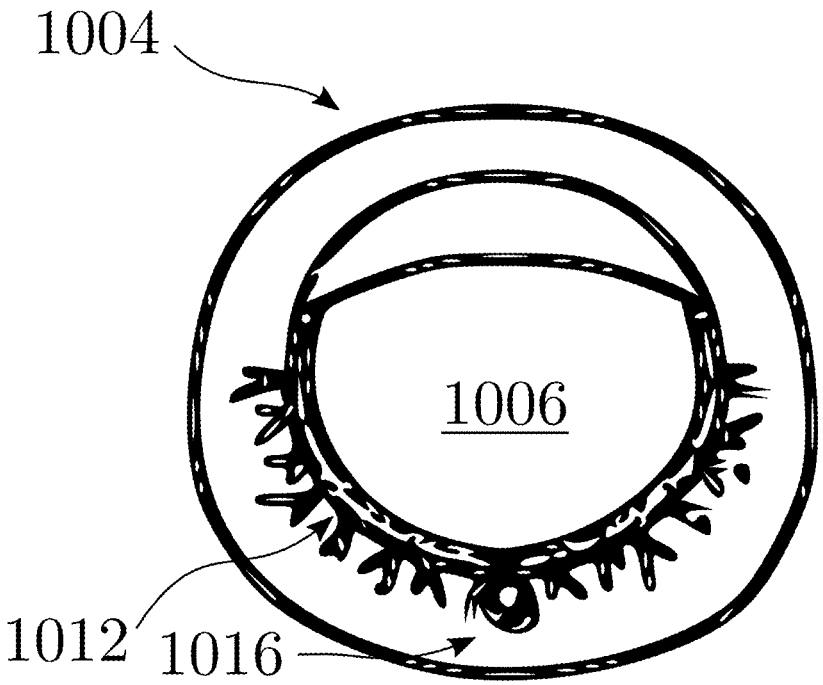
FIGS. 3A and 3B are front (FIG. 3A) and side (FIG. 3B) views of the inner bonnet of a hair covering in accordance with one embodiment of the present invention.
Figure 3B:
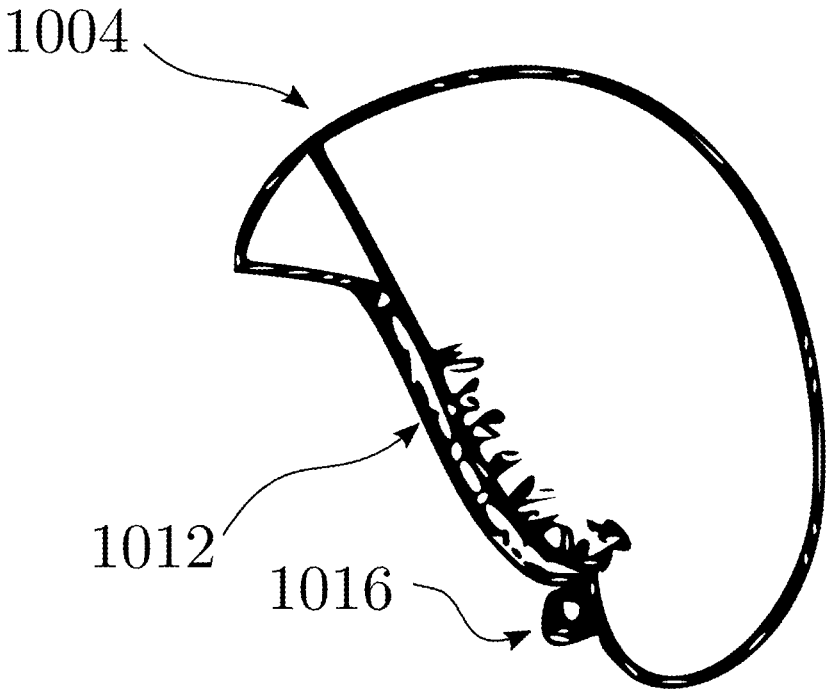

FIGS. 1A and 1B show respectively front and left-side views of a head covering (1000) in accordance with one embodiment of the present invention. The head covering includes an outer bonnet (1002) which is configured and dimensioned, e.g., through shape, contour, and printed image, to produce the effect of coiffure as described hereinbelow. An inner bonnet (1004) is dimensioned to enclose substantially the wearer's hair and skull (while leaving the face and chin free). The wearer's hair and skull are enclosed substantially in the volume 1006 formed when the circumference of the inner bonnet is constricted, e.g., by creating tension with a draw string (1012), or other device capable of constricting the wearer's hair and skull as described, using a cinch (1016). See also, FIGS. 3A and 3B. The materials and methods for construction will be familiar to those having ordinary skill in the art using the descriptions hereinbelow. In some more specific embodiments, draw string 1012 is an elastic cord. In other more specific embodiments, cinch 1016 can include an applique, and more particularly, an applique dimensioned and configured to keep draw string 1012 distributed evenly through the cinch. In still other more specific embodiments, an encasing material, such as double-fold satin tape (e.g., ½-inch double-fold satin tape) is applied to conceal the seam of the bonnet around draw string 1012 and casing panels.

Figure 2B:
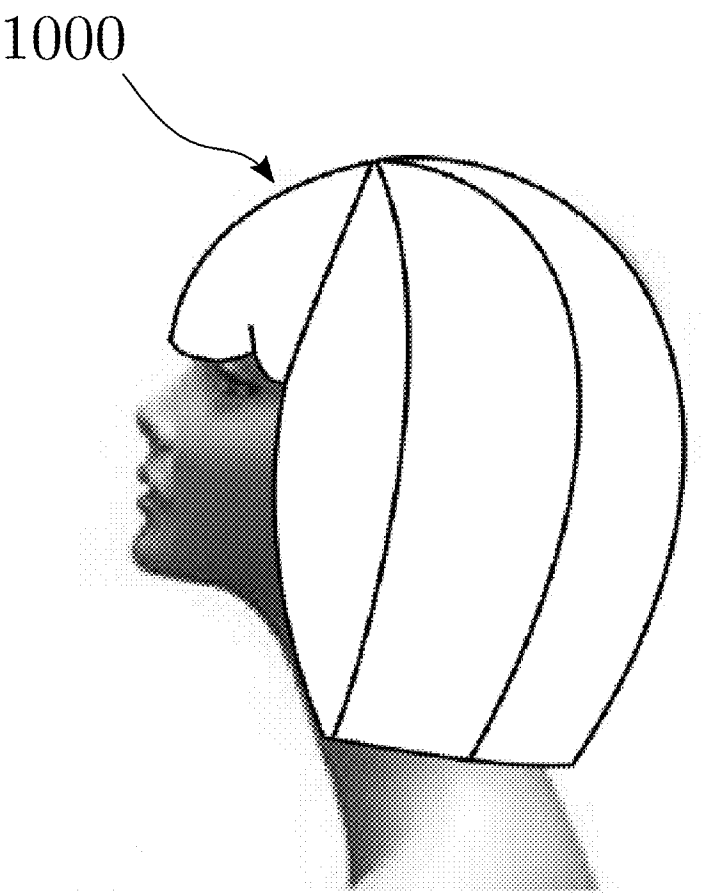
FIGS. 2A and 2B are illustrations of front (FIG. 2A) and side (FIG. 2B) views of an outer bonnet of a hair covering in accordance with one embodiment of the present invention as it appears on a wearer.
Figure 2A:
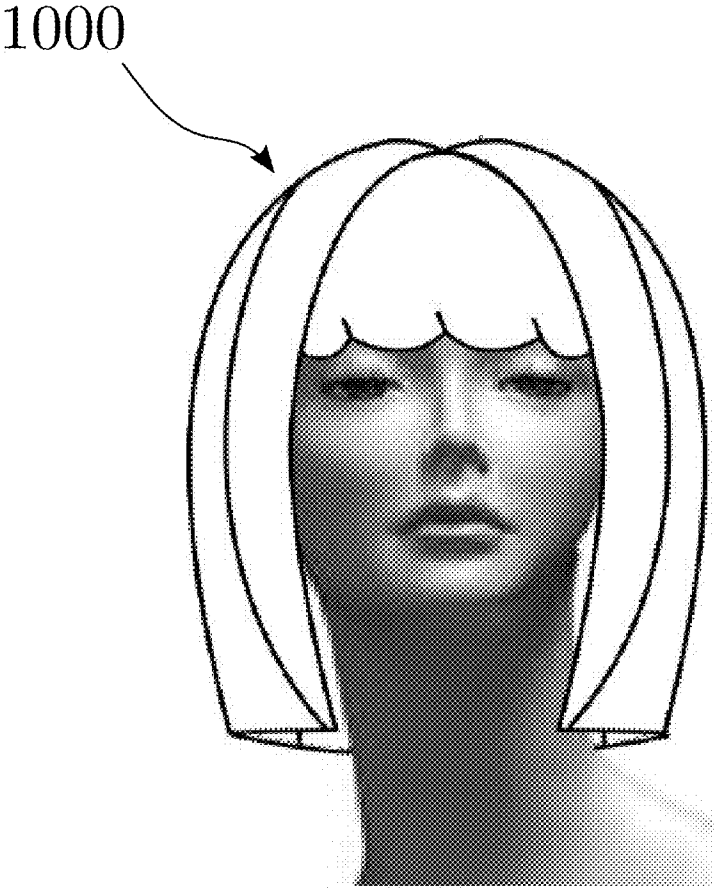

The outer bonnet (1002) is composed of a plurality of panels (1020*a*-1020*g*). The outer bonnet is constructed using methods and materials that are familiar to those having ordinary skill in the art using the descriptions hereinbelow. The outer bonnet is configured to provide the appearance of a coiffure, which is provided by printing coiffured hair on each of panels 1020*a*-1020*g* to provide the appearance of real coiffured hair as described hereinbelow (see, FIGS. 2A and 2B).

5.2 Bob-Style Bonnet

Referring again to FIGS. 1A and 1B outer bonnet has seven panels clockwise: front center crown, right front, right side, right back, left back, left side, left front. These panels are cut from double-lined layers, which increase the total panel count to 14. The layers of panels are cut and sewn together to complete the outer bonnet design. Metal snaps, two located on the left and right front panel and one located at the center crown panel (not shown), are stitched onto the interior of the outer bonnet and aligned with metal snaps sewn on the exterior of the inner bonnet to securely connect the two parts of the bonnet system.

One embodiment of an inner bonnet has two panels: the front and the back panel. The front panel contains two layers of fabric that are double-lined. Gripper elastic is stitched onto the interior part of the front panel hem to reduce movement. The back panel of the inner bonnet has one layer of fabric material, i.e, single-layer of double-faced material.

An elastic drawstring casing is stitched around the hem of the back panel of the inner bonnet. An opening is created at the lower-mid section of the hem line and is stitched to channel the elastic cord through the left and right side of the casing. The elastic cord is first channeled through the stopper, a double cord lock ends drawstring stopper, into the casing and stitched to prevent movement of the cord's end. The elastic casing provides adjustability and a desired fit for the wearer.

The front and back panels are stitched together and three separate snaps (located at the crown and both right and left sides of the temple) are aligned to securely hold and fit onto the outer bonnet. The inner and outer bonnet can have alternate forms that best support the wearer's particular hairstyle.

5.3 Wrap-Style Bonnet

Some wearer's prefer to protect hair by wrapping it around the head, while exposing the hair located at the crown of the head. This method is identified as the protective wrap method. The protective wrap method can be supported in the bonnet system by altering the inner bonnet design into a double-lined, one- or two-panel fabric material that surrounds only the circumference of the wearer's head, leaving the hair at the crown of the head exposed. The one or two panels overlap and attach at the front to create desired fit. The attachment is achieved with the use of fasteners that include snaps, Velcro® strips, or other suitable fastener. The snaps, located on the right and left temples, are also stitched onto the exterior of the panel(s).

The outer bonnet has at least four panels to include a front, crown, and left and right side panels, made from double-lined fabric, and will accommodate the volume of hair located at the crown of the head. The outer bonnet covers the wearer's head and is secured to the inner bonnet by aligning the snaps on the exterior of the inner bonnet with matching snaps on the interior of the outer bonnet.

5.4 Pineappling-Style Bonnet

Figure 6A:
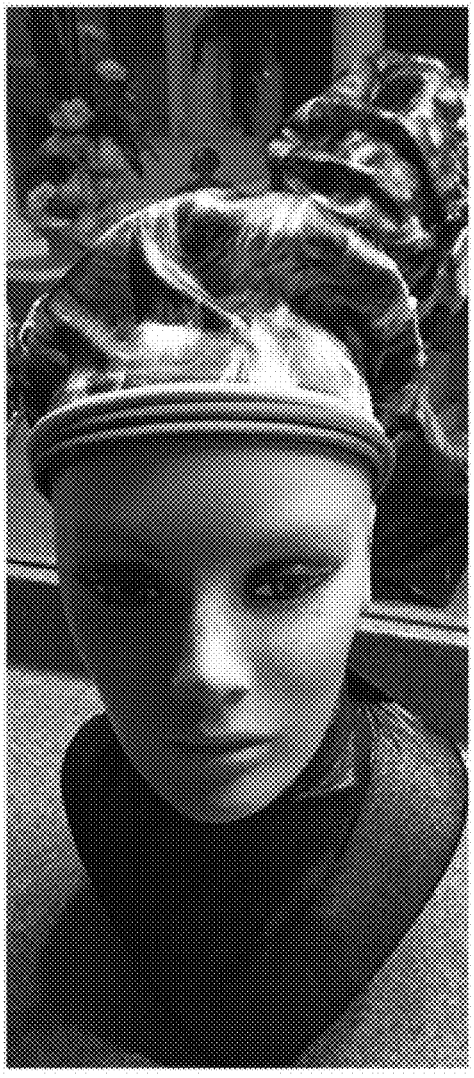
FIGS. 6A and 6B are view of a "pineapple" hair arrangement with wrap.

A protective style called "pineappling" includes gathering the wearer's hair together at the crown of the head and is secured with a type of elastic band, leaving the hair at the crown of the head free flowing. To provide a hair covering that is protective and supports the pineappling method, the inner bonnet of the wrap design is used in combination with a semi-fitted outer bonnet, where the semi-fit is achieved with the use of a stretchable type fabric material for the outer bonnet. The center crown area of the outer bonnet is altered to have an adequate opening wide enough for free-flowing hair to channel through and be exposed. The exposed hair is then covered by a third part (referred to herein as an "Attachment"), separate from the inner and outer bonnet. The Attachment of the design is a double-lined stretchable fabric that has metal snaps around the opening that are aligned with snaps on the exterior side of the outer bonnet. The Attachment of the design is interchangeable, giving the wearer the option of choosing various styles and design shapes for the outer bonnet. See, FIG. 6A.

Figure 6B:
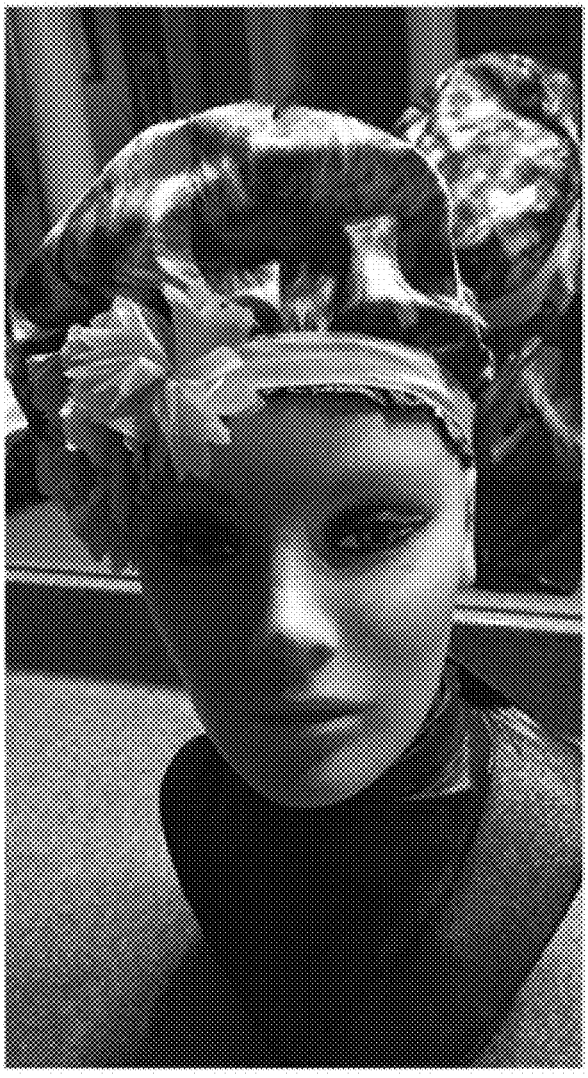

An alternative type of Attachment is in the form of interchangeable Accessories (graphically designed decorative headbands, bows, braids, flowers, etc.) that are attached onto the front panel of the exterior outer bonnet. In this embodiment of the outer bonnet, the attachment is connected to the outer bonnet by aligning Velcro® material or snaps on the underside of the accessorized attachment with the same added to the exterior of the outer bonnet. See, FIG. 6B.

5.5 Styles and Sizes

Figure 4:
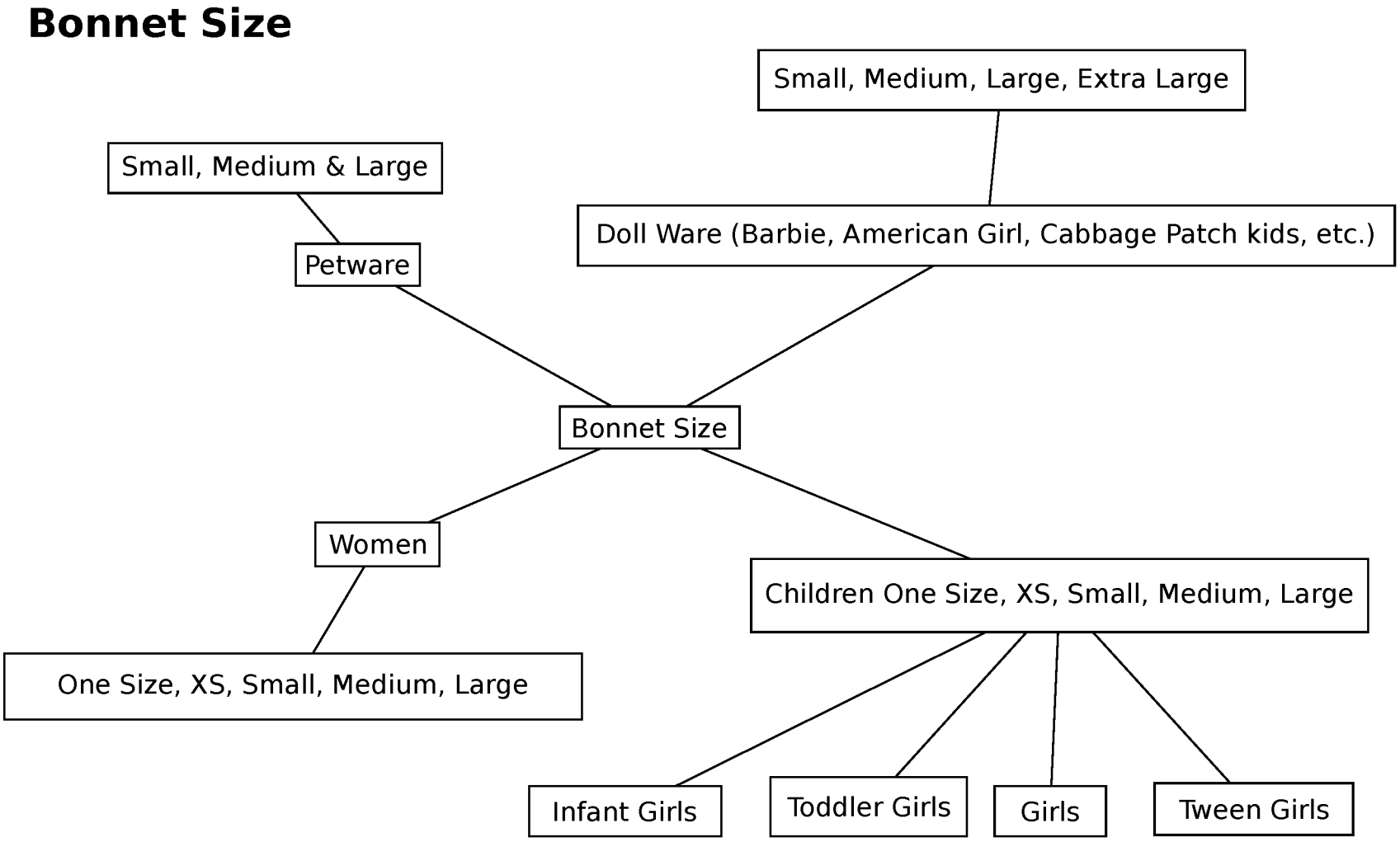
FIG. 4 is an illustration of various sizes of hair covering.

A wide variety of style and sizes are compatible with the head coverings provided by the present invention as illustrated in FIG. 4. An illustrative description of hair style can be found here: en.m. wikipedia.org/wiki/List_of_hairstyles. In one aspect, the present invention provides a "style library" comprising a catalog of bonnets and hair styles inspired by various genres, eras, and fads, such as: celebrity personalities, Disney, Mattel, American Girl, etc.

5.6 Fabrics and Materials

Figure 5:
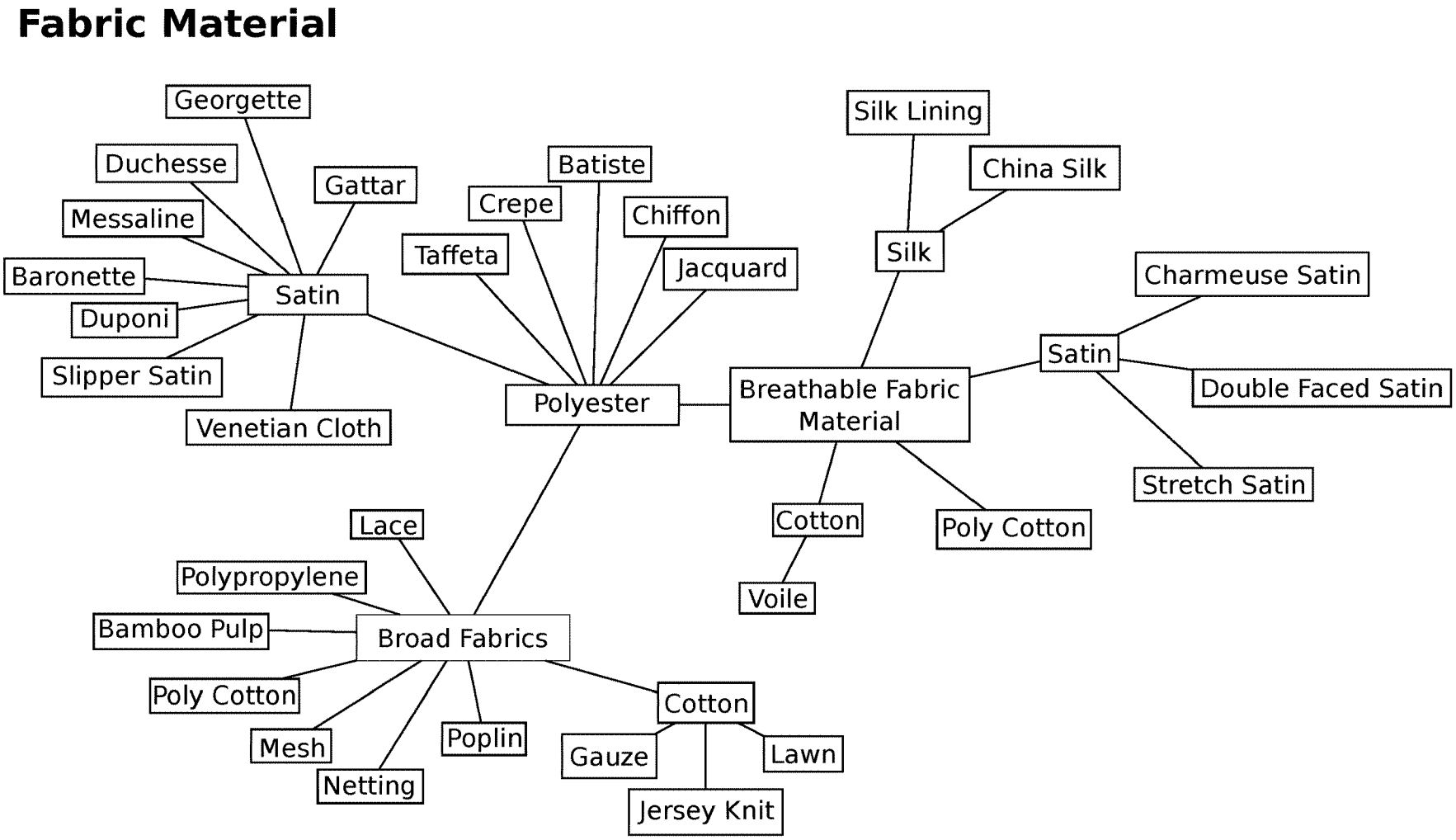
FIG. 5 is an illustration of various materials and fabrics for use in the present invention.

FIG. 5 shows some of the various fabrics and materials that can be used with the present invention. Fabric Material selection is essential to providing protection and comfort for the bonnet system. The primary function of the bonnet system is to reduce friction of the hair against fabric material, as well as breathability to the wearer's head. Satin and silk are preferred fabric materials for this invention. Satin is a very smooth and considerably lightweight fabric that prevents the wearer's hair from being tangled up while sleeping, reduces breakage, and retains moisture to the hair. Silk is a good alternative to satin. It is a natural fabric that retains moisture better than cotton. However, satin is more durable and cost effective than silk.

Charmeuse satin is one preferred fabric material for the inner bonnet. The front of the Charmeuse is smooth to the touch and shiny, while the back of the fabric material is dull and not as smooth in texture. The interior of the inner bonnet has the front side of the Charmeuse satin facing inward, as well as the casing that surrounds the back of the bonnet to provide less friction to the wearer's hair. The dull, back side of the Charmeuse fabric faces outward which is the exterior part of the inner bonnet.

The outer bonnet interior is lined with a polyester material called China Silk. It is a very lightweight material that provides breathability for the wearer's head. The exterior outer surface of the bonnet is the front, smooth side of Charmeuse satin, to reduce outward friction with object the bonnet system may come in contact with.

Details of suitable fabrics will be known to those having ordinary skill in the art, such as, e.g.:

www.craftsy.com/blog/2013/10/choosing-fabric-for-clothes/, www.naturallycurly.com/curlreading/curl-products/what-should-you-be-sleeping-on-silk-or-satin/, and www.naturallycurly.com/curlreading/curly-hair-care-methods/the-real-satin-bonnet/

5.7 Notions

Notions are used to properly construct the bonnet system to ensure durability and provide adjustability, for a secured fit. The following are examples of suitable notions for use with the present invention.

1. Ties. Use of two stitched fabric stripes channeled through and partially stitched into the inner bonnet casing makes an alternative notion that provides adjustability and fit, when both strips are tied together.
2. Fasteners. Buttons, zippers, hooks-and-eyes, buckles, poppas and eyelets. Examples of various fastener notions are as followed: The preferred notions that best suit the needs of protection and security for the bonnet system are the snap fasteners and double cord drawstring stopper. Although Velcro has been considered, snap fasteners reduce the risk of damage to the wearer's hair.
3. Elastic. Elastic is a narrow fabric that stretches due to its composition. Rubber or spandex cores are wrapped in a fiber such as polyester, nylon or cotton and then woven, knitted or braided to create the elastic. There are various types of elastic and it is important to consider the elastic that accommodates the best comfort, garment life and ease of sewing. See, Galvin, Beth. "Quick Guide to the Different Types of Elastic for Sewing", Craftsy. Craftsy and Sympoz, 29 Oct. 2015. Web. 24 May 2016 (www.craftsy.com/blog/2015/10/types-of-elastic-for-sewing/). Elastic is an integral part of securing the desired fit of the inner bonnet onto the wearer's head. Elastic can be used with or without casing. The use of elastic casing prevents friction between the elastic and hairline wisps, whereas unencased elastic may cause temporary imprints, facial marks and hairline friction. The preferred elastic for the interior front panel of the inner bonnet is the gripper elastic, to secure hold to the wearer's head. Further examples can be found here:

www.createforless.com/buying-guides/sewing-and-quilting/elastic-choosing-the-right-type-for-your-project.aspx 4. Cord. Due to the wide array of design options for the inner and outer bonnets, various elastic cords may be used to maintain hair protection and a secure fit.
5. Threads
   (a) General Threads
   (b) Nylon/rayon threads (including invisible thread)
   (c) Metallic threads
   (d) Bobbin threads (for machine sewing)
   (e) Designer threads
   (f) Cotton threads (including all-purpose cotton, stranded cotton, coton perlé, and Cotton à broder)
   (g) Tatting thread
   (h) Flower thread (i) Quilting thread
(j) Polyester threads (including all-purpose thread and heavy duty)
(k) Rayon threads
(l) Silk threads (including silk floss, twisted silk, stranded silk, and silk ribbon)
(m) Wool threads (including Persian wool, tapestry wool, and crewel wool)

Two useful threads are all-purpose cotton and polyester threads.

5.8 Stitching

A variety of stitching methods and materials familiar to those having ordinary skill in the art can be used in conjunction with the present invention.

5.9 Graphics and Printing

The process of developing graphic images for printing on the outer bonnet ranges from the following non-limiting list of computer graphic processes: User interface design, sprite graphics, vector graphics, rendering, 2D modeling, 3D modeling, shaders, GPU design, Raster, UV unwrapping/mapping, and computer vision. Some useful graphics methods for this invention are the 3D modeling and Raster. These methods consist of capturing detailed panoramic images of hair strands of a hairstyle via photographic imagery. The image is then edited and aligned with the desired shape of the outer bonnet panels, through a series of photographic manipulation layers. The preferred use of software such as Adobe Photoshop, allows the transforming or altering of photograph using various methods and techniques to achieve desired results.

There are various printing processes for fabric printing. Some of the more traditional printing processes include: Rotary, Flatbed, Screen, Hand block, Hand screen, silk screen, Gel, and Digital textile, and Direct transfer printing. Modern technologies increase resolution and quality include 3D printing and Dye Sublimation.

One useful print method used for the bonnet system is the dye sublimation method. Dye Sublimation is a permanent printing process that gives a well defined quality of print. The process includes transferring the desired patterned image and download onto a software that allows the pattern images to be aligned and adjusted for print. The pattern images are then printed on printed paper. The selected polyester fabric is placed on the heating mechanism and covered with the printed paper image. Once the heat-generated process begin, the heat is used to transfer due onto fabric permanently.

Additional details of dye sublimation can be found in various locations known to those having ordinary skill in the art, such as here: fabricgraphicsmag.com/articles/0110_f3_debate. html.

5.10 Examples of Construction of Head Coverings

5.10.1 Inner and Outer Bonnet System Construction

The following example shows the construction of the "Bob style" for the inner and outer bonnet patterns. The patterns are based on a one size fits most standard, which is achieved by the capacity of the outer bonnet and the inner bonnet's adjustability in its use of the drawstring method. The shape of the inner bonnet supports the shape of the outer bonnet by the unique shape of its front and back panels.

There is a minimum of two panels required for the inner bonnet, which number of panels achieves the result of maintaining the shape and adequate capacity that complies with the outer bonnet's structure. Casing fabric is used to channel the drawstring and provide adjustability for a desired fit.

Charmeuse satin is the fabric used for the inner bonnet. This fabric is selected based on its smooth, lightweight texture that supports the inner bonnets function of reducing friction and disheveling to the wearer's hair.

5.10.1.1 Construction of a Bob-Style Inner Bonnet

Materials Needed:

Two pattern panels: front panel (two layers) and back panel (one layer)
Casing fabric (52"×2")
Gripper elastic (10½)
Elastic cord (21½)
Double cord lock ends stopper
Three metal stud snaps
All-purpose cotton or polyester thread Construction of the Inner Bonnet:

1. Cut one layer back panel pattern shape from Charmeuse fabric.
   (a) Cut and fold the Charmeuse fabric for casing, allowing the satin side of the fabric to face outward.
   (b) Cut and stitch an opening at the middle section of the fabric casing, to allow the elastic cord to channel through properly.
   (c) Surge the casing hem from end to end.
   (d) Stitch together the casing and back panel.
2. Align two layers of Charmeuse fabric for the front panel.
   (a) Although both of the layered patterns will be identical in shape, face the bottom layer's fabric satiny-smooth side downward, and face the top layer's satiny-smooth side upward. (Please Note: This alignment creates the double lined method, whereas the top layer is the exterior sides and the bottom layer is the interior side of the inner bonnet.)
   (b) After alignment, cut the layers, per the front panel pattern.
   (c) Align the (interior) bottom hem of both layers and stitch from end to end. (Please Note: The stitching together of both the layers hem allows the panel to be evenly aligned, while maintaining the double faced method.)
   (d) Align the gripper elastic ¼-inch above the (bottom layer's) front panel hem, center, and stitch the top end of the elastic onto the bottom layer. (Please Note: The gripper elastic is visible on the satin faced, (interior) side of the inner bonnet.)
   (e) Align both layers of fabric and stitch the hem of both layers, along with the top end of the gripper elastic.
3. Take the elastic cord and channel both ends through the double cord lock ends stopper, into both sides of the casing. Once the cord is fully channeled through the casing, stitch across the cord ends and a downward stitch alongside the cord by three inches (to secure from movements and prevent elastic gathering behind the ear). (Please Note: The gathering of the cord in the casing channel begins past the three inch stitch and allows adjustability to the wearer when the drawstring stopper is functioned properly, for a desired fit.)
4. Stitch the stud snaps on the exterior left and right side temples (located on the front edge of the back panel, measured approximately 10" in between temple to temple) and center crown of the inner bonnet. (Please Note: The stub snaps will properly align with the socket snaps on the (interior) outer bonnet.)

5. Align and stitch the front panel with the back panel. (Please note, The end result of the inner bonnet stitched properly aligns the interior (satiny smooth) side of the back panel in unison with the interior front panel (which the gripper elastic is exposed.)

Construction of the Outer Bonnet

There is a minimum of seven panels required for the (Bob style) outer bonnet. It was determined that this number of panels maintain the shape of the style and supports adequate capacity for the inner bonnet. Charmeuse satin and China silk are the fabrics used for the outer bonnet. Charmeuse satin is selected for the exterior side of the outer bonnet; its lightweight texture provides comfort as the 3rd layer (1st inner bonnet, 2nd interior outer bonnet lining, and 3rd exterior outer bonnet) of fabric used in the bonnet system. Both fabric materials are 100% polyester, which provides a superior quality in dye sublimation printing.

Materials Needed:

Seven pattern panels (two layers, one each of Charmeuse and China silk): Front center panel, right front panel, right side panel, right back panel, 1-left back panel, left side panel, left front panel.

Three Metal stud snaps

All-purpose cotton or polyester thread

Construction for the (Bob Style) Outer Bonnet:

1. Align two layers (one each of Charmeuse and China silk lining as the inner layer) of fabric together. (Please Note: Place the bottom (China silk) layer's fabric face downward and the top (Charmeuse satin) layer's face upward. The China silk lining panel may be cut ⅜" shorter than the outer Charmeuse portion of the pattern panels.)
   (a) After alignment, cut the layers, per the front panel pattern.
   (b) Separate the layers and turn its panels inside out.
   (c) Stitch the panels (right front, right side, right back, left back, left side, and left front) together.
   (d) Align both layers inside out and stitch the bottom hem of both fabrics, from end to end.
   (e) Fold the seam of the layers hem toward the (interior) lining and under-stitch the (China silk) lining to the seam.
   (f) Under-stitch from end to end of the layers bottom edge (above listed) panels.
2. Separately stitch darts on both (interior side) layers, per the front center panel pattern.
3. Align the front center panels inside out and stitch from end to end. (Please Note: Leave a small opening to turn the front panel layers right side out.)
4. Fold the seam of the (front center panel) layers hem toward the (interior) lining and under-stitch the (China silk) lining to the seam.
5. Under-stitch from end to end of the front panel layers scalloped edge and along through the edge of left and right panels seam.
6. Stitch the socket snaps on the interior left and right front side seams and ½" below the center crown left and right back panels seam of the (interior) outer bonnet. (Please Note: The stub snaps will properly align with the socket snaps on the (Exterior) inner bonnet.)

5.10.1.2 Printing

Here is a list of steps used to prepare the images and pattern for printing.

1. Open the raster image file of the hair in raster image editing software.
2. Select only the pixels of the hair and separate them from the background.
3. Save the isolated pixels as new raster image file.
4. Open the vector art file of the fabric pattern in vector editing software.
5. Place the raster image of the hair into the vector file.
6. Move (and scale if necessary) the raster image to align with the outline curves of the panel.
7. Select the vector curves for the outline of the fabric panels.
8. Use the selected curves as a mask for the images.
9. If necessary use a raster clone tool to copy parts of the image to fill in any areas where the raster image is missing hair within the mask.
10. Repeat steps 1-9 but using a raster image that corresponds with the orientation of the fabric panel that you intend to use as a mask. For example use an image taken from the left side of the subject to use with a left side panel.
11. If necessary, when proceeding with further image masking, the underlying masked images may need to be shifted within the masks to align better with adjoining panels. This is to achieve a smooth transition between panels when sewn together and to give the appearance of full head of hair.
12. Save the vector artwork of the pattern with the hair in a format that is used by the printer.

5.10.1.3 Directions for Wear

1. Align the inner bonnet's gripper elastic along the hairline.
2. Pull the back panel over the wearer's head and tuck the hair underneath the elastic casing.
3. Adjust the double lock ends stopper for a desired fit. (Please Note: Tuck the exposed drawstring cord inside the back panel for concealment.)
4. Locate and align the snaps of the outer bonnet onto the snaps of the inner bonnet together.
5. Pull the outer bonnet over the inner bonnet (back panel) and cover accordingly.

6 CONCLUSION

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

What is claimed:

1. A head covering configured to protect a wearer's hair and provide a simulated hair style, comprising:

an inner bonnet, including at least one layer of fabric material and dimensioned to fit said wearer's head and substantially protect said wearer's hair, wherein the wearer's hair and skull are enclosed substantially in the volume formed by constricting the circumference of the inner bonnet;

an interchangeable outer bonnet, including at least one layer of fabric material with at least four panels and dimensioned to fit over said inner bonnet and cover substantially said inner bonnet from external view; said interchangeable outer bonnet being configured to accommodate the volume formed by the inner bonnet and appear substantially as a coiffure, wherein said outer bonnet is printed with an image of coiffured hair and said outer bonnet is configured in shape and surface contour to produce the effect of a coiffure; and said inner bonnet and interchangeable outer bonnet being coupled together to form said head covering.

2. The head covering of claim 1, wherein said inner bonnet comprises one or two layers.

3. The head covering of claim 2, wherein said inner bonnet comprises a plurality of panels.

4. The head covering of claim 3, wherein said inner bonnet comprises fewer than about seven panels.

5. The head covering of claim 4, wherein said panels are doubled.

6. The head covering of claim 1, wherein said inner bonnet is dimensioned to support said surface contour.

7. The head covering of claim 1, wherein said outer bonnet comprises one or two layers.

8. The head covering of claim 7, wherein said outer bonnet comprises a plurality of panels.

9. The head covering of claim 8, wherein said outer bonnet comprises fewer than about seven panels.

10. The head covering of claim 9, wherein said panels are doubled.

11. The head covering of claim 1, further comprising an accessory.

12. The head covering of claim 1, wherein each of said inner bonnet and said outer bonnet comprises silk or satin.

13. The head covering of claim 12, wherein said inner bonnet includes satin, and said outer bonnet includes silk and satin.

14. The head covering of claim 13, wherein said inner bonnet is Charmeuse satin.

15. The head covering of claim 14, wherein said outer bonnet is China silk and Charmeuse satin.

* * * * *